US005523743A

United States Patent [19]

Rattman et al.

[11] Patent Number: 5,523,743

[45] Date of Patent: Jun. 4, 1996

[54] SELF-DIAGNOSTIC SMOKE DETECTOR

[75] Inventors: William J. Rattman, Orlando, Fla.; Zhexin Mi; John Peterson, both of Toronto, Canada

[73] Assignee: Digital Security Controls Ltd., Downsview, Canada

[21] Appl. No.: 422,512

[22] Filed: Apr. 13, 1995

[51] Int. Cl.[6] ..... G08B 17/107

[52] U.S. Cl. ..... 340/630; 340/628; 250/205; 250/574; 356/338; 356/438

[58] Field of Search ..... 340/628, 630, 340/693; 250/573, 574, 205; 356/438, 439, 338

[56] References Cited

U.S. PATENT DOCUMENTS

| | | | |
|---|---|---|---|
| 3,868,184 | 2/1975 | Marsocci | 340/630 |
| 4,232,307 | 11/1980 | Marsocci | 340/630 |
| 4,321,466 | 3/1982 | Mollory et al. | 340/630 |
| 4,595,914 | 6/1986 | Siegel | 340/629 |
| 4,616,928 | 10/1986 | Leavitt et al. | 340/630 |
| 4,647,785 | 3/1987 | Morita | 340/630 |
| 4,687,924 | 8/1987 | Galvin et al. | 250/216 |
| 4,695,734 | 9/1987 | Honma et al. | 340/630 |
| 4,728,935 | 3/1988 | Pantus et al. | 340/506 |
| 4,749,871 | 6/1988 | Galvin et al. | 340/630 |
| 4,827,247 | 5/1989 | Giffone | 340/630 |
| 4,930,095 | 5/1990 | Yuchi et al. | 364/571.01 |
| 4,965,556 | 10/1990 | Brodecki et al. | 340/628 |
| 5,170,150 | 12/1992 | Austin et al. | 340/630 |
| 5,247,283 | 9/1993 | Kobayashi et al. | 340/630 |

*Primary Examiner*—Brent A. Swarthout
*Assistant Examiner*—Daniel J. Wu

[57] ABSTRACT

The present invention provides a method for detecting whether an alarm circuit is operating outside its sensitivity range, the alarm circuit having a background signal and a preset alarm threshold signal. The method involves: a) multiplying the background signal by a first gain factor to produce a first test signal; b) comparing the first test signal against an alarm threshold signal; c) multiplying the background signal by a second gain factor less than the first gain factor to produce a second test signal; and d) comparing the second test signal against the alarm threshold signal. The alarm circuit is operating outside its sensitivity range when the first test signal is less than the alarm threshold signal or the second test signal is greater than the alarm threshold signal.

17 Claims, 7 Drawing Sheets

SELF-DIAGNOSTIC SMOKE DETECTOR

FIELD OF THE INVENTION

The present invention relates to a smoke detector that is able to indicate when it has drifted in sensitivity from its original factory setting in either direction (more or less sensitive). In a preferred embodiment the smoke detector is also able to self-correct to restore the sensitivity to the factory set ranges.

BACKGROUND OF THE INVENTION

Light scattering smoke detectors are in common use and are based upon the principle that the presence of smoke or other particulate matter in a projected light beam will cause scattering of the light beam. Such smoke detectors have a light emitter broadcasting or projecting a light beam into a smoke chamber. If a suitable detector is placed in an area within the smoke chamber where the direct light from the projected light beam does not fall upon the detector but rather only scattered light from the beam, then the detector can be calibrated to determine the amount of particulate matter present in the smoke chamber based upon the amount of scattered light detected. Once a certain threshold level of light falling on the detector is reached or exceeded, such that the output of the detector exceeds a preset value, the smoke detector alarm circuits are activated.

In light scattering smoke detectors the presence of extraneous particulate material such as dust within the smoke chamber will cause a degree of light scattering and can raise the background level of the smoke detector and give rise to false alarms. Dust accumulation is the predominant degradation mechanism in optical scattering smoke detectors and results in an increase in the background signal while the threshold signal level required to set off the alarm stays constant. This results in a reduction in the difference between these levels and thus increases the sensitivity of the detector.

Other potential problem areas for light scattering smoke detectors relate to component degradation or the presence of materials in the atmosphere which may cause a film to be deposited upon the light elements, the emitter and detector. The degradation of the components or the presence of such films may cause a reduction in the intensity of the light beam from the emitter as well as a reduction in the detected light level of the scattered light beam by the detector. In either or both of these situations, the sensitivity of the detector would be reduced such that higher smoke levels would be required to reach the threshold signal level and trigger the alarm. This could lead to potentially increased risk of loss of life and property damage as the fire condition would be further advanced prior to detection.

There have been a number of designs of light scattering and other types of smoke detectors developed which have utilized various means for testing for signal level required to activate the alarm. For example, U.S. Pat. No. 3,868,184 describes providing a wire of a size to mimic the amount of light scattering produced by 2 to 10% per foot smoke obscuration which can be rotated into the light beam to test for the sensitivity of the smoke detector. Also, U.S. Pat. No. 5,170,150 describes the use of an external device to rotate a reflective element into the light beam to test for sensitivity.

There have also been some attempts in the past to design smoke detectors which measure background and when it has degraded to too large (or too small) a value so as to substantially shift the detector's alarm point, a trouble indication is given.

U.S. Pat. No. 4,930,095 by Yuchi describes an addressable smoke detector which "corrects" for optical sensitivity changes with a reference light source but ignores background changes. An additional light emitter broadcasting in close proximity to the photodetector is set to produce a receiver output signal equal to that attained from the main light emitter and photodetector at the smoke alarm point. When the panel sends a test command to a particular unit, the added light emitter is turned on and the receiver output signal is compared to the original value. Differences are normalized out by rescaling the output transducer sensitivity. The patent ignores the possibility of background change causing the measured response change with the Test light emitter activated.

U.S. Pat. No. 4,595,914 by Siegel describes an ionization detector with a clock to periodically shunt the ion chamber circuit with fixed resistors to impose a minimum and then a maximum sensitivity test with the alarm sounder being inhibited during these self test levels which bracket the intended alarm sensitivity. Response of self test outside the bracketed range results in a unique trouble signal.

U.S. Pat. No. 4,965,556 describes an ionization detector which automatically performs the test for minimum smoke sensitivity equivalent to the manual push button test at the same time each week so as to relieve the resident from having to perform this test. Occupants will come to expect this test and not be bothered by the alarm sound. Failure of the unit to respond to the self test will cause the occupants to repair the unit.

U.S. Pat. No. 4,687,924 by Galvin; U.S. Pat. No. 4,695,734 by Honma; U.S. Pat. No. 4,728,935 by Pantus; U.S. Pat. No. 4,749,871 by Galvin, and; U.S. Pat. No. 4,827,247 by Giffone all describe projected beam detectors with periodic self test where the received signal is compared to the original value at time of installation (or initiation). Compensation is applied in small steps to restore original sensitivity. Projected beams suffer mainly from loss of signal with time due to contamination of optical surfaces although they are configured to compensate for signal increase. The correction time base is long and correction is made in very small steps to prevent masking a slow smouldering fire's long smoke density buildup.

U.S. Pat. No. 4,647,785 by Morita and U.S. Pat. No. 5,247,283 by Kobayashi describe adding extra optical components as a check on the main smoke detecting pair and presume that the extra pair will somehow be immune to the degradation to which the main pair are subjected. Kobayashi also describes transmitting through the insect screen to check for excessive dust buildup.

In some of these devices the degree of smoke alarm point shift may be inferred from the background measurement and may be indicated by annunciation. Correcting these prior art detectors which have shifted in sensitivity generally requires their removal from the installed location and servicing and readjustment possibly at the factory or other service location.

SUMMARY OF THE INVENTION

In one aspect, the present invention provides a smoke detector having a specified sensitivity range and being capable of determining whether the detector is operating within its specified sensitivity range. The detector comprises a light emitter broadcasting a light beam into a smoke chamber, and a light detector viewing into the smoke chamber and capable of detecting the level of light scattered as a result of the presence of smoke particles in the smoke chamber. The output of the light detector is proportional to the amount of scattered light striking the detector. The detector also includes an alarm circuit means for annuciating an alarm when the output of the light detector reaches or exceeds an alarm threshold level. The detector is provided with a control circuit means including means for producing test signals indicative of the optical sensitivity of the smoke detector and the background level of the output of the smoke detector in the absence of smoke particles, and means for determining from the test signals whether the smoke detector is operating within its specified sensitivity range.

In another aspect, the present invention provides a method for detecting whether an alarm circuit is operating outside its sensitivity range, the alarm circuit having a background signal and a preset alarm threshold signal. The method comprises:

a) multiplying the background signal by a first gain factor to produce a first test signal;

b) comparing the first test signal against an alarm threshold signal;

c) multiplying the background signal by a second gain factor less than the first gain factor to produce a second test signal; and d) comparing the second test signal against the alarm threshold signal;

whereby the alarm circuit is operating outside its sensitivity range when the first test signal is less than the alarm threshold signal or the second test signal is greater than the alarm threshold signal.

In yet another aspect, the present invention provides a method for maintaining an alarm circuit within its sensitivity range, the alarm circuit including an emitter and a detector and having a background signal and a preset alarm threshold signal. The method comprises:

a) multiplying the background signal by a first gain factor to produce a first test signal;

b) comparing the first test signal against an alarm threshold signal;

c) multiplying the background signal' by a second gain factor less than the first gain factor to produce a second test signal;

d) comparing the second test signal against the alarm threshold signal; and e) adjusting the emitter output and/or the alarm threshold signal if necessary to maintain the first test signal greater than or equal to the alarm threshold signal and the second test signal less than or equal to the alarm threshold signal.

BRIEF DESCRIPTION OF THE DRAWINGS

The above as well as other advantages and features of the present invention will be described in greater detail according to a preferred embodiment of the present invention in which.

DETAILED DESCRIPTION OF THE PREFERRED EMBODIMENTS

The present invention relates to a smoke detector that is able to indicate when it has drifted in sensitivity from its original factory setting in either direction (more or less sensitive). In a preferred embodiment, the smoke detector is also able to take measures to correct the drift to restore the sensitivity to the original factory set ranges.

Light scattering smoke detectors are based upon the principle that the presence of smoke or other particulate matter in a projected light beam will cause scattering of the light beam. As described above, such smoke detectors have a light emitter broadcasting or projecting a light beam into a smoke chamber having a suitable detector placed in an area of the smoke chamber where the direct light from the projected light beam does not fall upon the detector. The detector views into the smoke chamber such that the scattered light from the beam due to the presence of smoke particles in the chamber falls upon the detector. The output of the detector is proportional to the amount of light falling upon it and hence the amount of smoke particles in the chamber. The response of the smoke detector is governed by the transfer equation and may be adjusted by selection or adjustment of the value of any one or more of the parameters of the transfer equation for optical sensitivity photoelectric smoke detectors as follows:

$$V_{sn}=I_{LED}*Q_{LED}*\ 1/A_s*n*R_e*R_L*A \quad (1)$$

where Vsn=optical sensitivity in Volts/%/ft obscuration of smoke $I_{LED}$=LED (light source) current in Amperes $Q_{LED}$=LED Quantum Efficiency in Watts/Ampere $A_s$=Smoke Area illuminated by the LED in $cm^2$ n=Scattering Efficiency of Gray Smoke in $(\%/ft)_{-1}$ $R_e$=Photodiode Detector Responsivity in Amps/Watt/$cm^2$ $R_L$=Photodiode Load Resistance in Ohms A=Voltage Gain The sensitivity of a smoke detector is set based upon a particular level of smoke at which the detector will annunciate an alarm according to the following equation governing the Alarm Point, S, the sensitivity of the smoke detector, is $$V_{cal}=V_{sn}*S+V_b, \text{ where} \quad (2)$$

$V_{cal}$=Alarm Threshold in Volts

Figure 1:
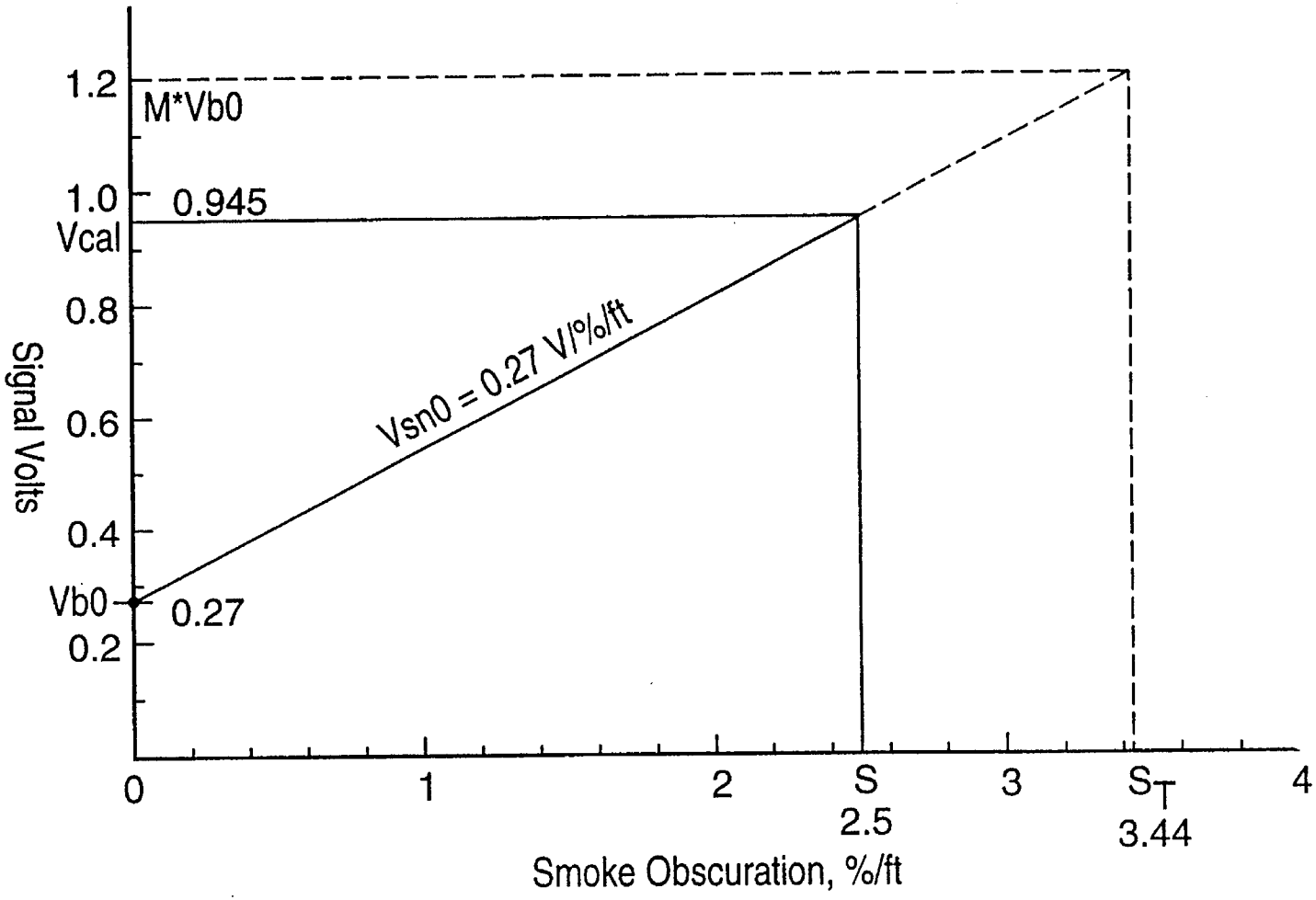
FIG. 1 is a graph of the relationship between smoke obscuration and output signal voltage of a typical optical smoke detector.

S=Alarm Point (Detector Sensitivity) in %/ft $V_b$=Background Reflection from Chamber in Volts This equation has been graphed for one set of parameters in FIG. 1.

In a well designed unit the Background is proportional to the light emitter drive current and is bounded with small dispersion. The relationship of the optical sensitivity to the background is expressed as a normalized figure of merit for the design as $$NFM=V_{sn}/V_b \quad (3)$$

The NFM for an optical smoke detector is preferably selected to be unity, that is the detector is designed such that the value of $V_{sn}$ equals the value of $V_b$.

The present invention in a preferred embodiment provides a smoke detector having a specified sensitivity range and being capable of determining whether the detector is operating within its specified sensitivity range. The detector has a light emitter broadcasting a light beam into a smoke chamber and a light detector viewing into the smoke chamber capable of detecting the level of light scattered as a result of the presence of smoke particles in the smoke chamber. The output of the light detector is proportional to the amount of scattered light striking the detector. The smoke detector has an alarm circuit means for annunciating an alarm when the output of the light detector reaches or exceeds an alarm threshold level. The detector is provided with a control circuit means including means for producing test signals indicative of the optical sensitivity of the smoke detector and the background level of the output of the smoke detector in the absence of smoke particles, and means for determining from the test signals whether the smoke detector is operating within its specified sensitivity range.

Preferably, the control circuit means includes a means for producing a first test signal as an indication of the background level of the output of the light detector in the absence of smoke particles, a means for producing a second test signal as an indication of the optical sensitivity of the smoke detector and a means for comparing the test signals to the alarm threshold signal to determine whether the smoke detector is operating within its specified sensitivity range.

The two most common mechanisms in the degradation of smoke detectors are increases in the background caused by dust build-up resulting in increased sensitivity of the smoke detector and decreases in optical sensitivity, $V_{sn}$, caused by component degradation or a build-up of attenuating dirt or grease films on the optical element resulting in decreased sensitivity of the smoke detector. The decreases in the $V_{sn}$ are generally also associated with the decrease in the background as a result of the component degradation or attenuating films and in such circumstances, the normalized figure of merit NFM generally remains at or close to its original value. The first situation, an increase in background as a result of dust accumulation, does not generally affect the optical sensitivity and hence the NFM of the smoke detector generally decreases.

Of the two degradation mechanisms, the decrease in optical sensitivity is the more critical as this decreases the sensitivity such that the level of smoke required to activate the alarm circuitry increases. In such situations, the fire may be well advanced before the alarm sounds and hence the occupants of the building in which the alarm is located will have less time to evacuate the premises. In some prior art smoke detectors, this situation is monitored by comparing the background to the alarm threshold signal and when the background has decreased to cause the alarm point to be shifted to too high a level of smoke, then the unit indicates this situation.

The smoke detector of the present invention may determine a decrease in optical sensitivity simply by comparing the background of the unit at the time of testing to the background of the unit at the time of manufacture. This may be done by a simple comparison between the measured background at any point in time and the background level at time of manufacture which may be stored in the memory of the unit. Alternatively, the background may be compared to the alarm threshold signal to indicate the headroom of the smoke detector, that is the difference in the signal levels of the background and alarm threshold signal. This may be accomplished by multiplying the background voltage level by a gain factor to produce a test signal which is then compared against the alarm threshold signal $V_{cal}$. So long as the test signal exceeds the alarm threshold signal $V_{cal}$, then the smoke detector's optical sensitivity has not degraded. If the test signal is less than the alarm threshold signal, then this is an indication that the background and the optical sensitivity $V_{sn}$ have decreased to a level where an unacceptably high level of smoke would be required to cause the output of the detector to exceed the alarm threshold signal and annunciate an alarm.

Increases in background caused by dust build-up may also be determined by comparing the real time background signal to that of the unit at time of manufacture or by determining the headroom between the background signal and the alarm threshold signal. Preferrably the headroom is determined by multiplying the background signal $V_b$ by a second gain factor to produce a second test signal and comparing this second test signal to the alarm threshold signal. The gain factor is preferrably selected such that in a properly operating unit the second test signal is less than the alarm threshold signal. So long as this situation exists, then the background of the smoke detector is such to allow for an acceptable level of sensitivity of the smoke detector. Should the background increase beyond an acceptable level, then the second test signal will exceed the alarm threshold signal and an indication of increased sensitivity of the smoke detector is given. This test may be accomplished by simply multiplying the background signal by a second gain factor lower than that of the first. Alternatively, to enable the smoke detector to obtain an indication of the $V_{sn}$, this second gain factor may be derived from a combination of the first gain factor and a reduction of one of the parameters of the transfer equation for $V_{sn}$ to result in a combined gain factor which is less than that of the first gain factor. The most likely parameter for adjustment of the transfer equation are the light source current or the voltage gain. Of these two, the easiest to adjust is the amperage of the light source current. Thus, the reduction in the light source current will cause a reduction in the $V_{sn}$ and the background and multiplying this reduced background by the first gain factor gives rise to the second test signal.

The above test will indicate whether the smoke detector is operating within an acceptable sensitivity range or whether the smoke detector is operating outside the sensitivity range as a result of an increase in background caused by dust build-up or a decrease in background and $V_{sn}$ caused by component degradation or build-up of attenuating or grease films on the optical elements.

In a preferred embodiment, the smoke detector is also able to be corrected without having to be removed or serviced, in that, if the tests determine that the sensitivity has shifted in either direction such to affect the proper operation of the detector, then suitable correction measures are taken to restore the detector to an acceptable sensitivity. Increases in background which are the normal degradation mechanism caused by dust build-up do not generally affect the optical sensitivity of the smoke detector and generally may be compensated by raising the alarm threshold, $V_{cal}$, correspondingly to restore the high sensitivity condition back to the original sensitivity, $S_0$.

Decreases in background which are associated with component degradation or a build-up of attenuating dirt/grease films on the optical elements are preferably compensated for by raising the light emitter drive current to restore the optical sensitivity, $V_{sn}$, back to the original $V_{sn0}$ value to correct the low sensitivity situation back to the original smoke alarm point, $S_0$. However, simplified reductions of the $V_{cal}$ alarm threshold may be just as effective. The light emitter drive current increase method of restoring the original sensitivity leaves the detector with more "headroom" which adds a slight improvement in false alarm immunity to RFI.

A preferred embodiment of the present invention is a Microprocessor-based design which compares ongoing measured $V_b$ and $V_{sn}$ values from automatic periodic internal tests to the original values registered in the Microprocessor memory. When these parameters compute an NFM or Alarm Point Sensitivity that is outside acceptable limits for proper radio frequency interference/Dust Immunity and/or specified smoke sensitivity, a trouble condition will be annunciated calling attention to the fault condition at the Fire Alarm Panel. Depending upon the mode set into the unit at the time of manufacture, then the Operator at the Fire Alarm Panel may send a command instructing the detector to correct the condition or the unit may allow self correction of the fault condition. Interconnected hardwired 2-wire and 4-wire designs would communicate over the power lines; RF designs would communicate by the RF transmission.

In a preferred embodiment, the design does not require additional circuitry such as analog/digital convertors and comparators to handle the pulse response of the smoke detector but, rather, makes use of the built in self test capabilities of commercially available smoke detector control application specific integrated circuits (ASIC) which are only configured for testing for sensitivity decrease. The preferred method involves using the ASIC master clock as normal, to have a microprocessor count or track the self tests at regular intervals and to invert the sense of alternate self tests in conjunction with reducing the emitter drive current to achieve the presently non-existent test for high sensitivity. It is preferred that the self-diagnostic system not require polling of addressable detectors, but rather that the control panel sort the status messages from each detector as they occur.

It is also possible to provide a handheld interrogator to communicate with a single smoke detector at a time with status displayed in a down-link message from the detector to determine the status of the components, the self-diagnostic feature as well as any corrective measures which may have been implemented by the smoke detector.

The following example illustrates the parameter degradation occurring for both types of sensitivity change and shows one value for the reduced LED drive current for the High Sensitivity Test. The smoke detector of the following example utilizes a Motorola MC145010 ASIC as is explained further below.

The on-board Low Sensitivity Test of an ASIC such as the Motorola MC145010 channels the background, $V_b$, through a higher gain path by a gain factor, M, to determine whether the sensitivity, S, has degraded to the Test Strength value, $S_t$, where $$S_t=(M-1)/NFM \quad (1)$$

and $$NFM=V_{sn}/V_b \quad (2)$$

by determining if $$M*V_b>V_{cal} \quad (3)$$

The equation governing the relationship between detector parameters at the alarm point, S, is as set out above $$V_{cal}=V_b+V_{sn}*S \quad (4)$$

where $V_{sn}$ is the detector's optical sensitivity.

As illustrated in FIG. 1, parameter mid-values substituted in eq. (4) for a smoke detector with factory-set alarm sensitivities of 2.5%/ft results in the following. $S_O$=2.5%/ft, $V_{b0}$=0.27 volts, $V_{sn0}$=0.27 volts/%/ft, $V_{cal}$=0.945 volts, $NFM_0$=1 $(\%/ft)^{-1}$, and M=4.44

$$0.945=0.27+(0.27)*2.5, \text{ volts} \quad (4)$$

This example unit has a Test Strength, St, $$S_t=(4.44-1)/1=3.44\%/ft \quad (1)$$

The amplified background, M*Vb0, is $$M*V_{b0}=4.44*0.27=1.20 \text{ volts} \quad (3)$$

and so exceeds the alarm threshold, $V_{cal}$, by 0.255 volts. This excess relates to 0.255/0.27=0.94%/ft additional equivalent smoke obscuration beyond the alarm point sensitivity, S; thus, $$S_t=S+S_{excess} \quad (5)$$

$$S_t=S+[M*V_{b0}+V_{cal}]/V_{sn0} \quad (6)$$

$$S_t=2.5+0.94=3.44\%/ft$$

Increasing sensitivity from dust accumulation increasing the background is the predominant degradation mechanism in optical scattering smoke detectors. In this mode only $V_b$ increases. Optical sensitivity, $V_{sn}$, stays constant at $V_{sn0}$ as has been determined from dust tests.

To determine High Sensitivity when the background has increased to the point where the example detector has had its Alarm Point increased to $S_2$=2%/ft, a 20% increase, is accomplished by rewriting eq. (4) in terms of background, and solving for the degraded background, $V_{b2}$:

$$V_{b2} = K_2*V_{b0} = V_{cal} - V_{sn0}*S_2 \quad (9)$$
$$V_{b2} = K_2*V_{b0} = 0.945 - (0.27)(2) = 0.405 \text{ volts}$$
and
$$K_2 = V_{b2}/V_{b0} = 0.405/0.27 = 1.5$$

To determine at what optical efficiency reduction Low Sensitivity Trouble will be annunciated by this unit the Test Strength is substituted in eq. (4) as a degraded sensitivity, $S_1$, imposing the most logical constraint that the NFM remains constant at $NFM_0$. That is, it is reasonable that attenuating grease films and the like on LED/PD optical elements will reduce both the background and the optical sensitivity by a factor, $K_1$, less than 1. Rewriting eq. (4) so that background is in terms of optical sensitivity and NFM, results in $$V_{cal}=V_{sn}[S_1+1/\text{NFM}] \quad (7)$$

and then replacing $V_{sn}$ as a degraded optical sensitivity, $K_1*V_{sn0}$, the following is obtained $$V_{cal}=K_1V_{sn0}[St+1/\text{NFM}_0] \quad (8)$$

and $$K_1=0.945/[3.44+1/1](0.27)=0.79$$

Figure 2:
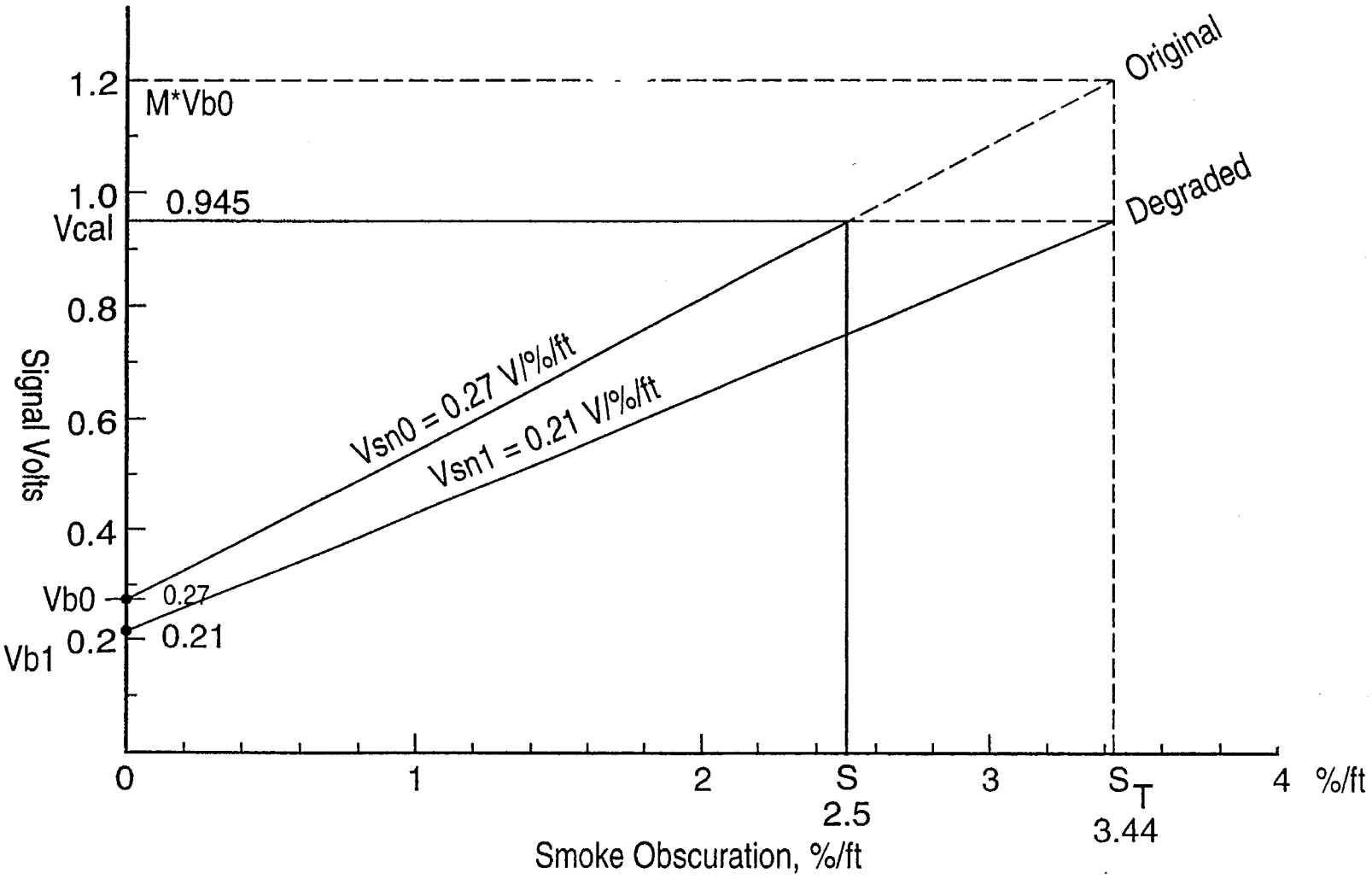
FIG. 2 is a graph comparing the relationship of FIG. 1 with a degraded sensitivity situation.

That is, a 21% reduction in optical sensitivity and background will degrade the detector's alarm sensitivity by 38% to 3.44%/ft. As illustrated in FIG. 2, the degraded detector parameters are:

$$V_{snl}=K_1*V_{sn0}=0.79(0.27)=0.21 \text{ Volts/\%/ft}$$

$$V_{b1}=K_1*V_{b0}=0.79(0.27)=0.21 \text{ Volts}$$

$S_1=S_t=3.44$ %/ft

While hypothetical variations on this degradation mode where NFM does not stay constant at $\text{NFM}_0$ may be possible, such modes will be more rare than the already rare Sensitivity Decrease.

Figure 3:
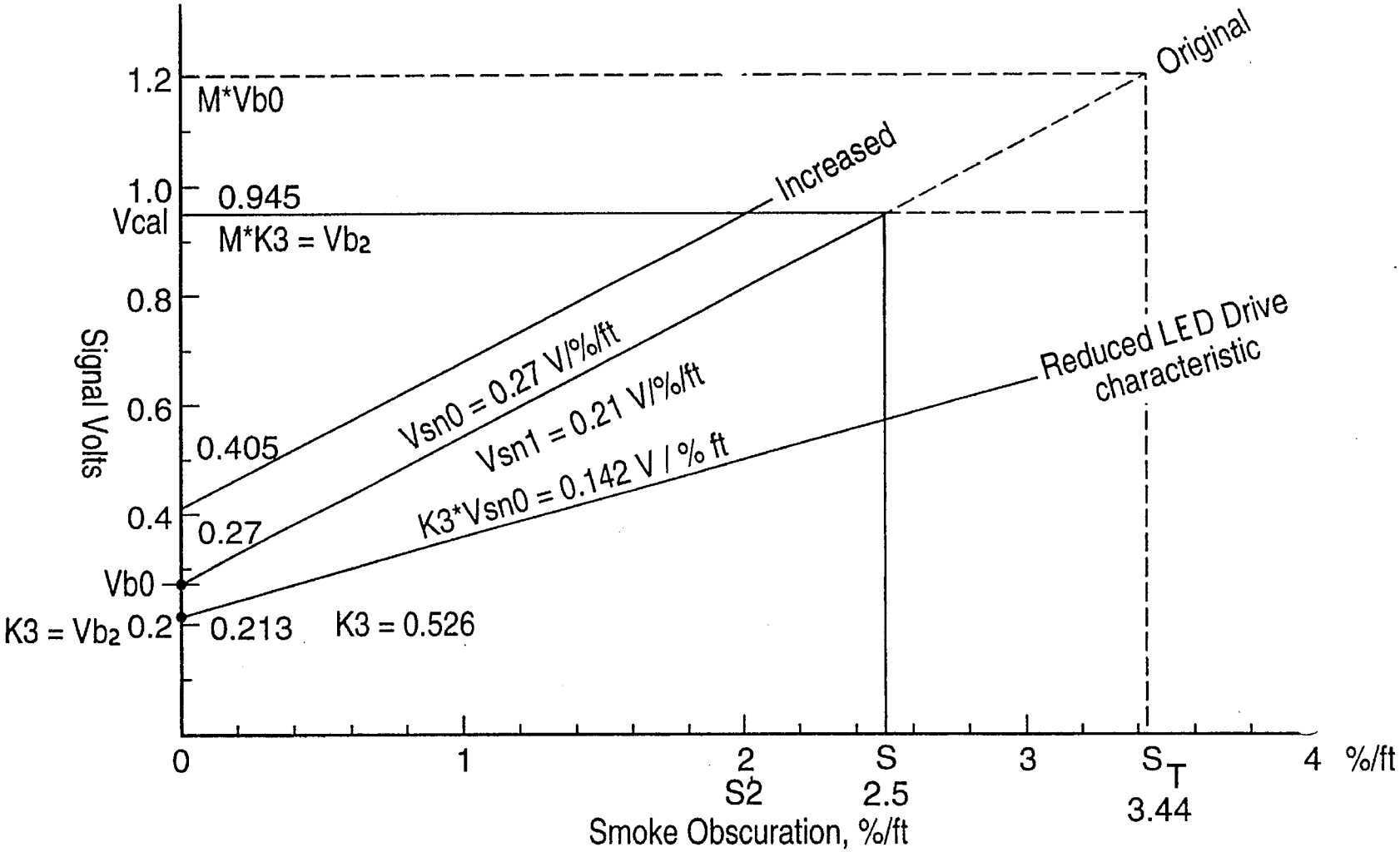
FIG. 3 is a graph comparing the relationship of FIG. 1 with an increased sensitivity situation.

In the smoke detector of the present invention, the microprocessor is utilized to invert the sense of the normal Low Sensitivity Test and annunciate Trouble when the increased background measured through the test channel reaches the alarm threshold, $V_{cal}$. The LED current during this test is reduced by a factor, $K_3$, less than 1, such that $K_3*K_2*V_{b0}*M>V_{cal}$ $K_3*1.5(0.27)4.44>0.945$ $K_3=0.526$ This situation is illustrated in FIG. 3.

The reduced LED drive is in one embodiment set by fixed resistors. Also this Self-Diagnostic design still operates with a single potentiometer for factory setting of alarm sensitivity, S.

As set out above, the transfer equation for the optical sensitivity photoelectric smoke detectors is $$V_{sn}=I_{LED}*Q_{LED}*1/A_s*n*R_e*R_L*A \quad (1)$$

where Vsn=optical sensitivity in Volts/%/ft obscuration $I_{LED}$=LED (light source) current in Amperes $Q_{LED}$=LED Quantum Efficiency in Watts/Ampere $A_s$=Smoke Area illuminated by the LED in $cm^2$ n=Scattering Efficiency of Gray Smoke in $(\%/ft)^{-1}$ $R_e$=Photodiode Detector Responsivity in Amps/Watt/$cm^2$ $R_L$=Photodiode Load Resistance in Ohms A=Voltage Gain Parameter center values for the smoke detector of the present example are:

$V_{sn}$=0.286 V/%/ft $I_{LED}$=0.207 A (adjustable parameter to set alarm point)

$Q_{LED}$=0.115 W/A $A_s$=0.684 $cm^2$ and therefore $1/A_s=1.461$ $cm^{-2}$ $n=2.24*10^{-6}$ $(\%/ft)^{-1}$ (decimal efficiency per unit gray smoke obscuration)

$R_e$=0.05 A/W/$cm^2$ (Siemens BPW34FA)

$R_L=0.27*10^6$ ohms

A=271

The equation governing the Alarm Point, S, the sensitivity of the smoke detector, is $$V_{cal}=V_{sn}*S+V_b, \text{ where} \quad (2)$$

$V_{cal}$=Alarm Threshold in Volts

S=Alarm Point (Detector Sensitivity) in %/ft $V_b$=Background Reflection from Chamber in Volts The relationship between the optical sensitivity and the background is expressed as a normalized figure of merit for the design as follows:

$$\text{NFM}=V_{sn}/V_b \quad (3)$$

In the smoke detector of the example to achieve NFM's of "unity", that is for average $V_{sn}$ above of 0.286 V/%/ft, the average background will be some 0.286 volts.

In the present example, the alarm threshold, $V_{cal}$, is 1 volt. Substituting parameter values in equation (2) gives $$1.00=0.286*S+0.286 \text{ and}$$

S=2.5%/ft, the central value smoke sensitivity setting for Canadian units. When setting other Smoke Alarm sensitivities, say 3.1%/ft for the United States or other countries, LED current is set at an average value of 0.177 amperes to establish a Vsn of 0.244 V/%/ft and a background of 0.244 volts. The fundamental adjustability of the LED drive current makes it one of the preferred means of manual or automatic adjustment in a Self Diagnostic design with a self-correction feature.

Means for changing the LED current to accommodate a changed Background which has shifted the Alarm Point, S, could utilize digitally activated switches which affect the current limiting resistor for the LED. A bank of resistors each shunted by a transistor in turn controlled by the microprocessor is one example. A network of a fixed resistor and two resistors having shunting saturable transistors would achieve a system of four possible resistance values, and consequently four LED current levels. A laser-trimmed fixed resistor to set the original Alarm Point at the factory may be utilized and the switchable resistors used to affect the needed background adjustment with the normal dust deposition in the installation or the rare condition of background decrease.

Another version of the digitally controlled resistor is the EEPOT Digitally Controlled Potentiometer, a device such as the X9CMME from Xicor with resolution of 1%, that is 100 selectable steps over the resistance range. Use of this type of device could provide the means for factory setting of sensitivity as well as the corrections needed in the field.

In the above example, a 21% Background Reduction will desensitize the Alarm Point by 38%. Such a fault condition is determined by the automatic Low Sensitivity Test. Also, a 50% Background Increase increased the Sensitivity by 20%. This fault condition was determined by the High Sensitivity Test. Depending upon the nature of the fault condition, different corrective actions may be warranted. For instance, where the Background (and Sensitivity) decreases are shown by the Low Sensitivity Test, but the High Sensitivity Test shows no fault condition, it may be desired to step up the LED drive current one step at a time until a Low Sensitivity Test shows the fault condition is eliminated. It may be necessary only to correct LED current as the NFM is expected to remain constant during the buildup of attenuating grease films reducing both the Background and the $V_{sn}$ equally. On the other hand, when the High Sensitivity Test produces a fault condition from Background Increase, the Higher background may be corrected by a raised Alarm Threshold to:

a. restore the Signal Headroom above Background, and b. restore the Alarm Point Sensitivity back to its original value.

Although this approach retains the degraded NFM condition forced by the dust growth, the voltage span (headroom) between the background level and new alarm threshold restores both the False Alarm Immunity to further dust growth and RFI to that built in at the time of original manufacture.

Figure 6:
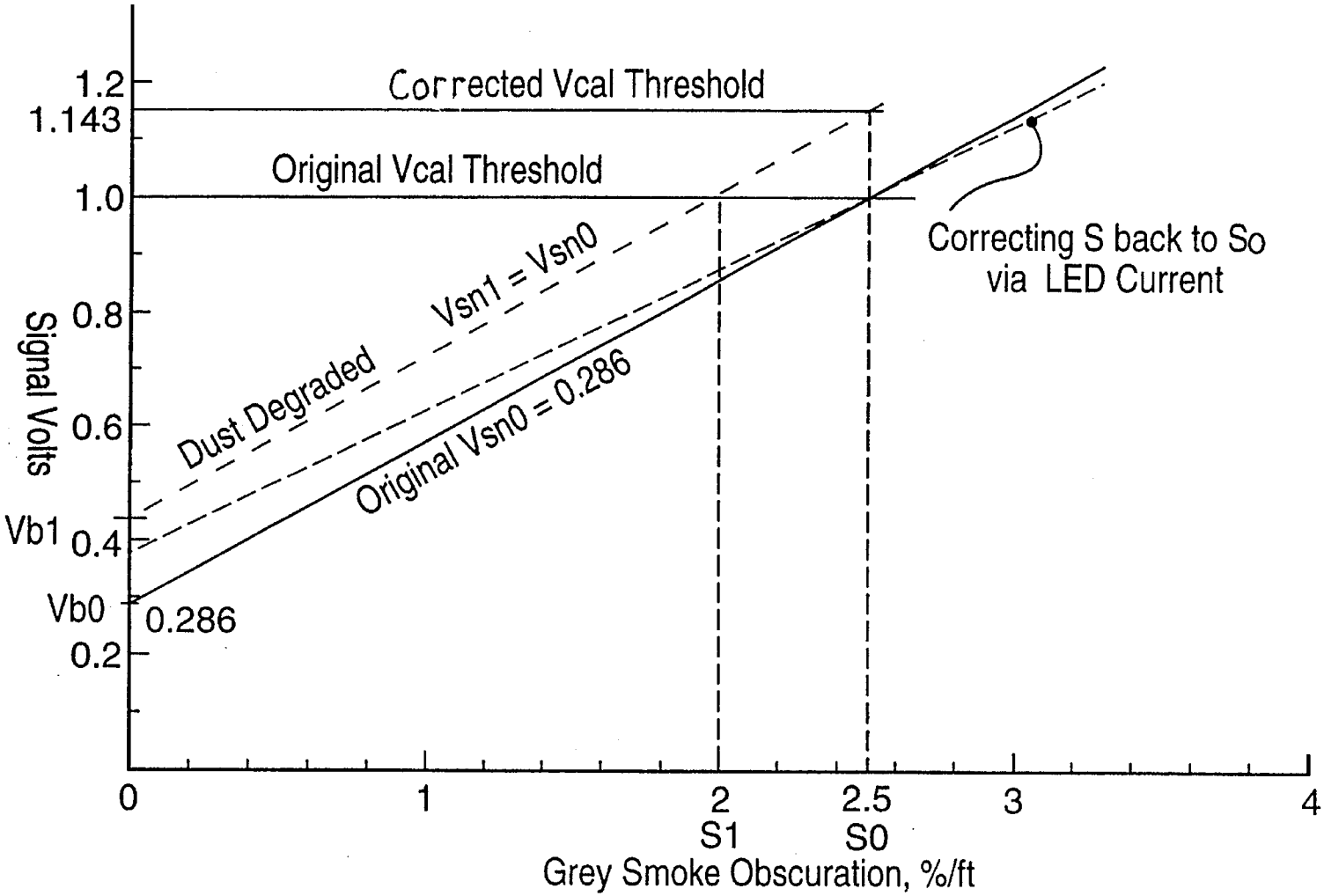
FIG. 6 is a graph illustrating the two possible correction methods for an increase in sensitivity due to the presence of dust particles of the smoke detector of FIG. 5.
Figure 7:
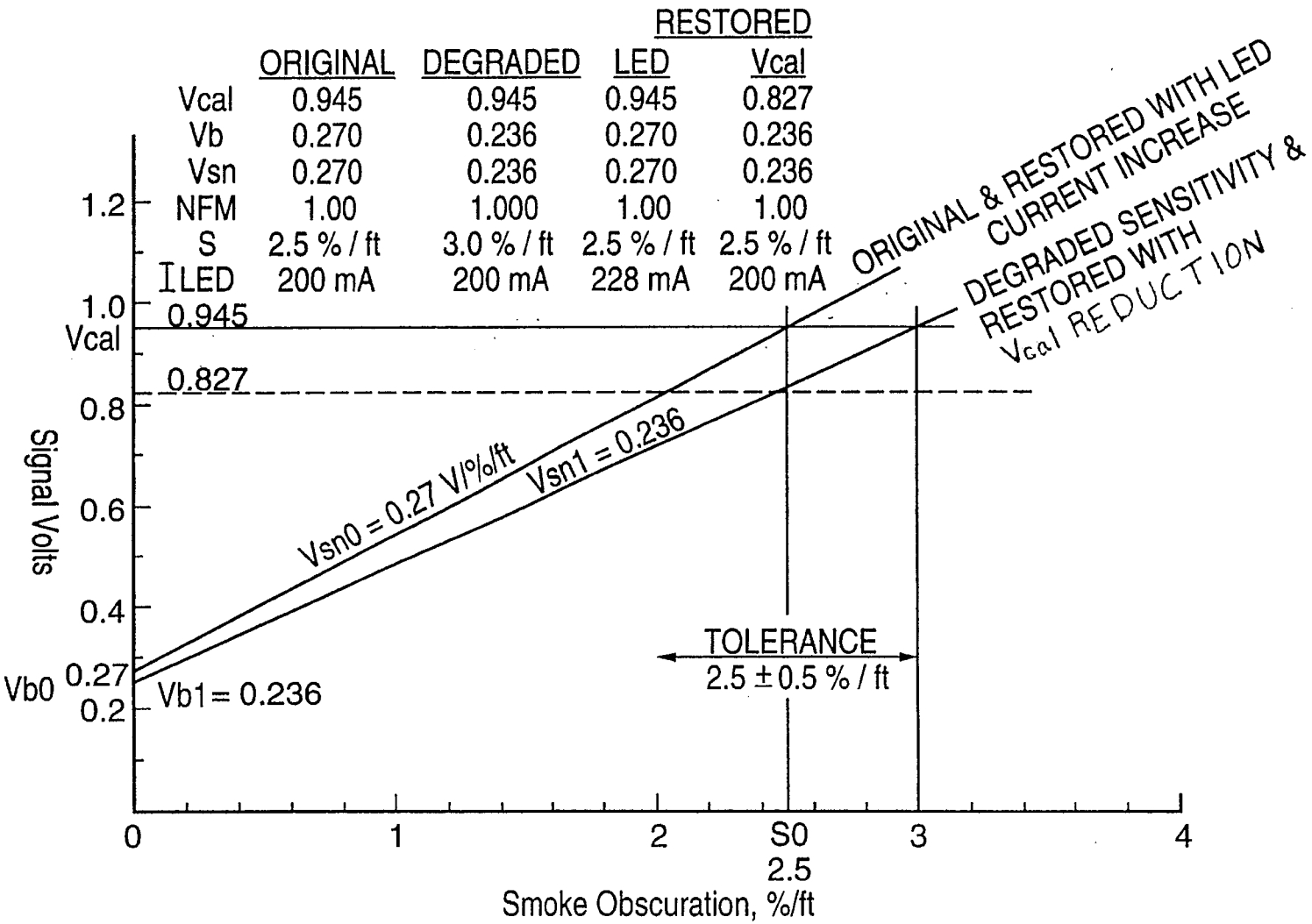
FIG. 7 is a graph illustrating the correction for a decrease in sensitivity due to the presence of film or degraded component performance of the smoke detector of FIG. 5.

An appreciation for distinctive parameter adjustments for the separate fault conditions can be obtained by examining FIG. 6.

Figure 4:
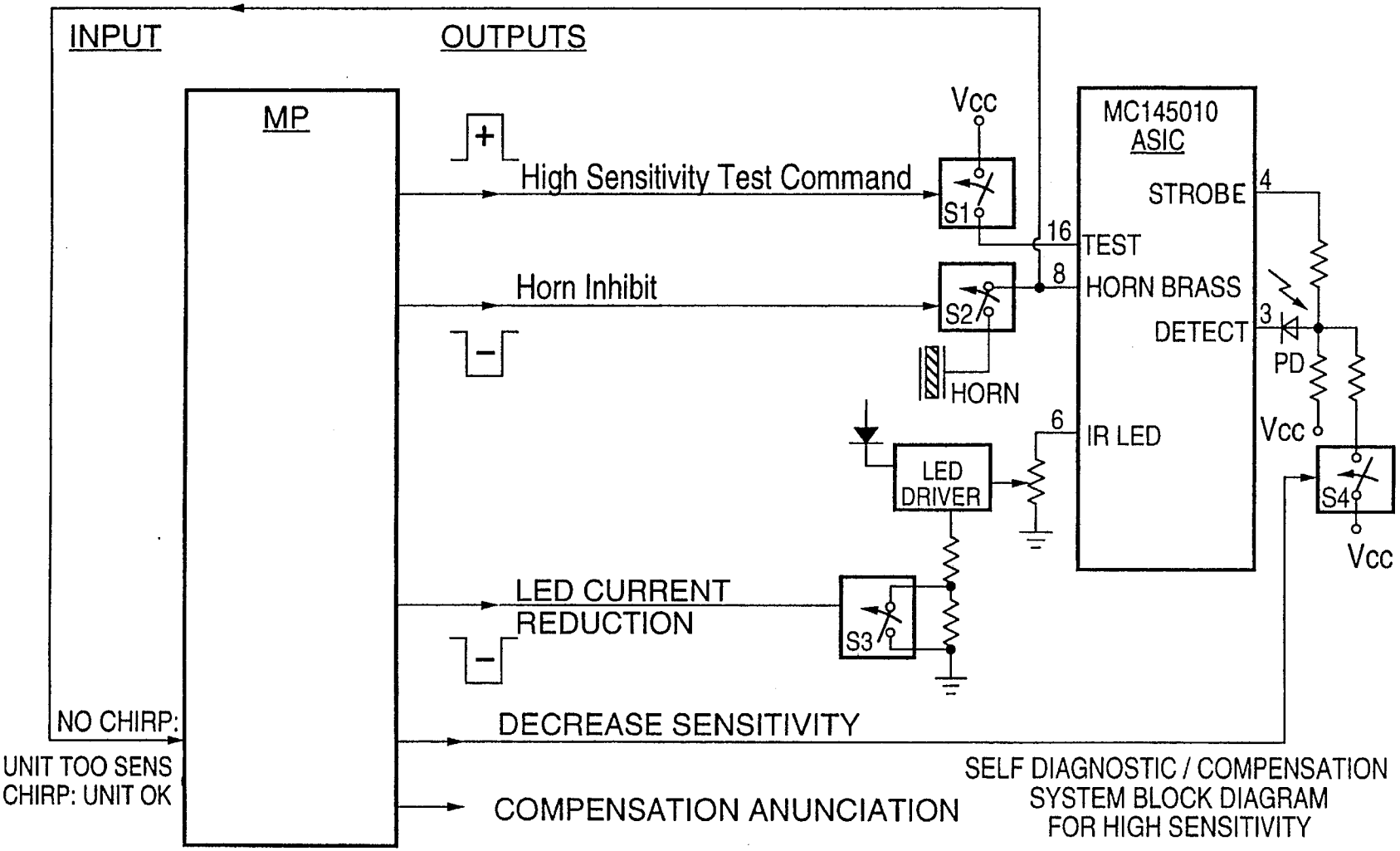
FIG. 4 is simplified block diagram of the microprocessor and smoke detector controller embodying the self-diagnostics of the present invention.

A preferred embodiment of the smoke detector of the present invention is illustrated in the block diagram shown in FIG. 4. A microprocessor provides the functions of a long time base clock initiating High Sensitivity Test Commands which are buffered to three active switches connected to typical photoelectric smoke detector elements as would be used in conjunction with application specific integrated circuits (ASIC) such as the Motorola MC145010, namely: Test Command, LED Driver, Alarm Annunciator (Horn). A single input to the microprocessor is taken from the ASIC Horn Driver. Two other microprocessor outputs are the Sensitivity Decrease Command to the active switch to adjust the Bias of the Photodiode receiver circuit and an Annunciation Signal of the fact that automatic compensation of the Detector Smoke Sensitivity has been put into effect.

In this semi-schematicized block diagram shown in FIG. 4, a positive output drives S1 to activate the Test Command to the detector circuit. Simultaneously, a negative output drives S2 to inhibit the "Trouble" Chirp at the horn from sounding and also drives S3 to lower the LED drive current. This approach essentially inverts the normal ASIC Test for Low Sensitivity. Here with lowered LED drive, if the unit has not become too sensitive, the alarm threshold will not be exceeded and the ASIC will provide a "chirp" pulse which will be processed at the input to the microprocessor as an indication that no compensation is required. If on the other hand, dust accumulation has driven the detector background up to a sufficient level to make it too sensitive, then application of this High Sensitivity Command will cause the alarm threshold to be exceeded and no "chirp" will be given from the ASIC. The processor will provide the fourth microprocessor output to activate S4 which will alter the bias at the Photodiode circuit to restore the sensitivity to the original manufactured value or some other appropriate value. Although the Normalized Figure of Merit, NFM, will remain reduced until the unit is eventually cleaned from the dust accumulation, the compensation will restore the original headroom above background that was built into the unit at the time of manufacture and thus restore the original False Alarm Immunity.

This High Sensitivity Test approach may be incorporated with additional circuitry processing the built-in Low Sensitivity Test which occurs at a regular interval, every 43 seconds, or so, for the Motorola MC145010. Here the Trouble chirp (in the absence of a High Sensitivity Test Command) would result in a command to drive an additional active switch increasing LED current. Thus, it is possible to achieve automatic compensation for sensitivity shifts in either direction and maintain manufactured sensitivity specifications of the alarm point (2.5+/−0.5%/ft).

Figure 5:
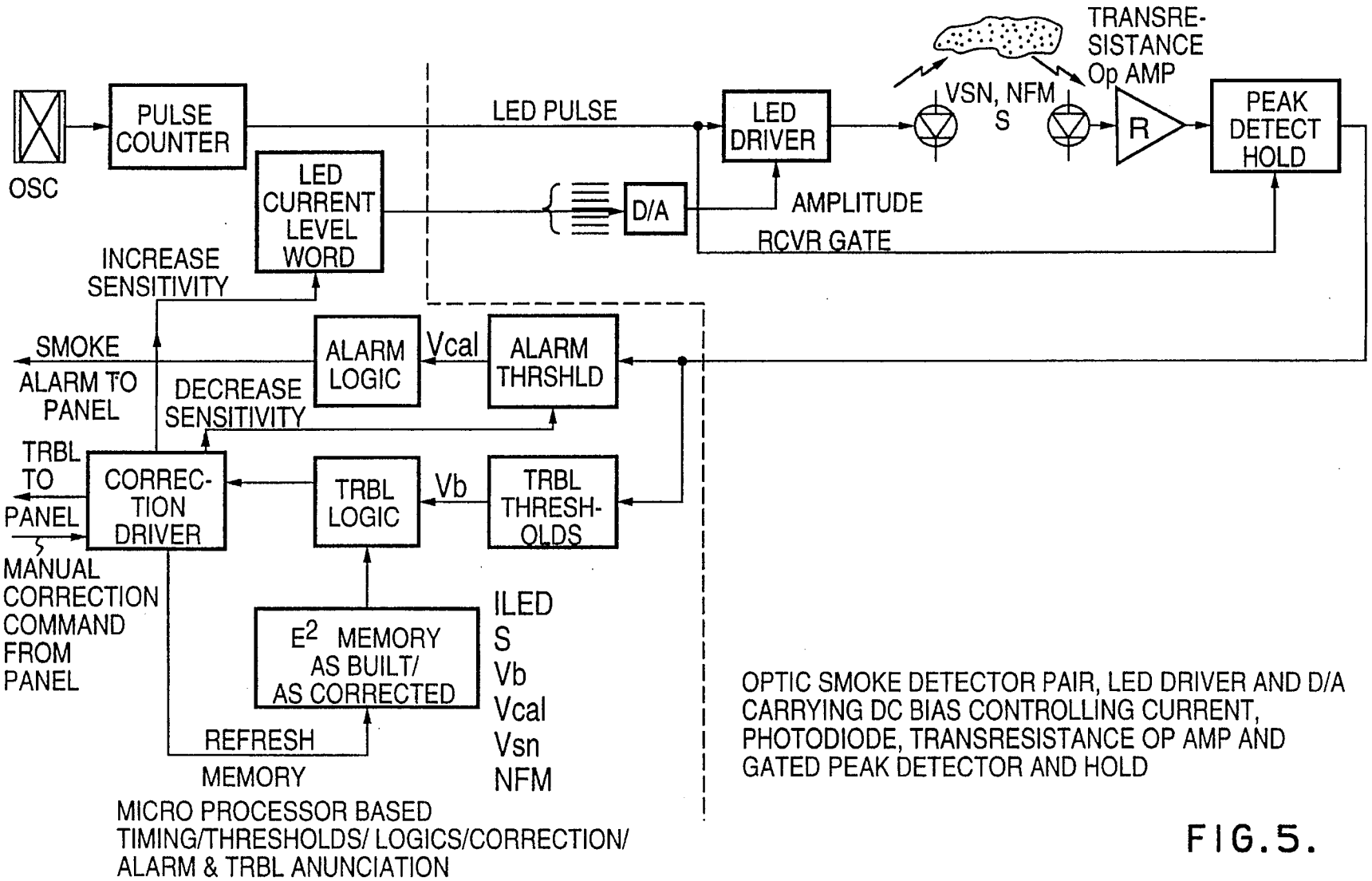
FIG. 5 is a simplified diagram of an optical smoke detector incorporating the self-diagnostics and self-correcting features according to a preferred embodiment of the present invention.

Referring to the Simplified Block Diagram shown in FIG. 5, a microprocessor based controller contains a master clock and pulse counter to command IR LED pulses to an amplitude controllable driver to set in the smoke alarm sensitivity at time of manufacture and as needed for sensitivity adjustment during its life in the installed location as determined by Trouble Logic. The background scattered chamber reflections and any smoke signal added thereto as detected by the photodiode and amplified by the transresistance amplifier is fed to the gated peak detector and held during the interpulse period for processing by the Alarm and Trouble Threshold and Logic circuitry. Pulses exceeding $V_{cal}$ constitute a smoke alarm condition at the factory set sensitivity, $S_0$.

Initial factory measured values ($V_b$, $V_{sn}$, NFM, S, $V_{cal}$ and $I_{LED}$) are set into memory. Trouble Thresholds above and below the as-manufactured value $V_{b0}$ are used to determine if the detector has drifted out of its specified sensitivity tolerance; i.e, 2.5+/−0.5%/Ft. This Trouble Thresholds block is comparable to a Window Comparator, the output of which is compared against stored values in memory to enable either automatic compensation or panel commanded correction to restore the detector to its original sensitivity. The option for automatic or commanded correction is set in at the factory via a jumper. Smoke Alarm and Trouble annunciation if desired are communicated to the panel via conventional means and may be grouped with address information.

Increases in background which are the normal degradation mechanism caused by dust build-up are generally compensated for by raising the $V_{cal}$ alarm threshold correspondingly to restore the high sensitivity condition back to the original sensitivity, $S_0$.

Decreases in background which are associated with component degradation or a build-up of attenuating dirt/grease films on the optical elements are ideally compensated for by raising the IR LED current to restore the optical sensitivity, $V_{sn}$, back to the original $V_{sn0}$ value to correct the low sensitivity situation back to the original smoke alarm point, $S_0$. However, simplified reductions of the $V_{cal}$ alarm threshold may be just as effective as is shown in FIG. 6 which displays the two corrective approaches. The LED current increase method of restoring the original sensitivity leaves the detector with more "headroom" which adds a slight improvement in false alarm immunity to RFI.

Some of the beneficial aspects of the Self Diagnostic smoke detector of the preferred embodiment of the present invention are:

1. Fault Condition allows Operator restoration to proper condition remote from the Fire Alarm Panel or, if configured at time of manufacture, automatically corrects in steps.
2. Original Background, Optical sensitivity, Smoke Alarm point, and Test Strength are stored in EEPROM for each individual detector (not based on some running manufacturing average or expected value).
3. Corrections restore detector to original manufactured parameter Alarm Point sensitivity and False Alarm Immunity (not a correction of say Alarm Point sensitivity while compromising False Alarm Immunity).

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A method for detecting whether an smoke detector alarm circuit is operating outside its sensitivity range, the alarm circuit having a background signal and a preset alarm threshold signal, the method comprising:

a) increasing the background signal by a first gain factor to produce a first test signal indicative of the optical sensitivity of the alarm circuit b) increasing the background signal by a second gain factor less than the first gain factor to produce a second test signal indicative of the background signal of the alarm circuit c) comparing the first and second test signals against the alarm threshold signal whereby the alarm circuit is operating outside its sensitivity range when the first test signal is less than the alarm threshold signal or the second test signal is greater than the alarm threshold signal.

2. A method as claimed in claim 1 wherein the alarm circuit includes an emitter and a detector and the second gain factor is derived from a combination of the first gain factor and an adjustment of the output of the emitter.

3. A method as claimed in claim 2 wherein the alarm circuit is an optical smoke detector with a light emitter and a light detector.

4. A method as claimed in claim 3 wherein the second test signal is generated by reducing the output of the light emitter to produce a reduced background signal which is then increased by the first gain factor.

5. A method as claimed in claim 4 wherein the output of the light emitter is reduced by reducing the current applied to the light emmitter.

6. A method for maintaining an smoke detector alarm circuit within its sensitivity range, the alarm circuit comprising an emitter and a detector and having a background signal and a preset alarm threshold signal, the method comprising:

a) increasing the background signal by a first gain factor to produce a first test signal indicative of the optical sensitivity of the alarm circuit b) increasing the background signal by a second gain factor less than the first gain factor to produce a second test signal indicative of the background signal of the alarm circuit c) comparing the first and second test signal against the alarm threshold signal f) adjusting the emitter output or the alarm threshold signal if necessary to maintain the first test signal greater than or equal to the alarm threshold signal and the second test signal less than or equal to the alarm threshold signal.

7. A method as claimed in claim 6 wherein the second gain factor is derived from a combination of the first gain factor and an adjustment of the output of the emitter.

8. A method as claimed in claim 7 wherein the alarm circuit is an optical smoke detector with a light emitter and a light detector.

9. A method as claimed in claim 8 wherein the second test signal is generated by reducing the output of the light emitter to produce a reduced background signal which is then increased by the first gain factor.

10. A method as claimed in claim 9 wherein the output of the light emitter is reduced by reducing the current applied to the light emmitter.

11. A light scattering smoke detector having a specified sensitivity range and being capable of determining whether the detector is operating within its specified sensitivity range, the detector comprising:

a light emitter broadcasting a light beam into a smoke chamber, a light detector viewing into the smoke chamber and capable of detecting the level of light scattered as a result of the presence of smoke particles in the smoke chamber, the output of the light detector being proportional to the amount of scattered light striking the detector, alarm circuit means for annuciating an alarm when the output of the light detector reaches or exceeds an alarm threshold level, control circuit means including means for producing a first test signal as an indication of the optical sensitivity of the smoke detector, means for producing a second test signal as an indication of the background level of the output of the light detector in the absence of smoke particles, and means for determining from the test signals whether the smoke detector has a fault condition and is operating outside its specified sensitivity range.

12. A smoke detector as claimed in claim 11 wherein the means for producing a first test signal as an indication of the optical sensitivity of the smoke detector comprises a means for increasing the background signal by a first gain factor.

13. A smoke detector as claimed in claim 12 wherein the means for producing a second test signal as an indication of the background level of the output of the light detector in the absence of smoke particles comprises a means for increasing the background signal by second gain factor.

14. A smoke detector as claimed in claim 13 wherein the means for increasing the background signal by the second gain factor comprises a means for reducing the output of the light emitter to produce a reduced background signal which is then increased by the first gain factor.

15. A smoke detector as claimed in claim 14 wherein the control circuit means includes a means for adjusting the current applied to the light emitter and a means for adjusting the alarm threshold level.

16. A smoke detector as claimed in claim 15 wherein the output of the light emitter is reduced by reducing the current applied to the light emmitter.

17. A smoke detector as claimed in claim 16 wherein the control circuit means includes means for adjusting the alarm threshold signal and/or the current applied to the light emitter to return the smoke detector to operating within its sensitivity range when the fault condition is determined.

* * * * *